United States Patent [19]

Namyslo

[11] 4,400,095

[45] Aug. 23, 1983

[54] PUSH BUTTON ASSEMBLY FOR A WATCH

[75] Inventor: Wilhelm Namyslo, Pforzheim, Fed. Rep. of Germany

[73] Assignee: Timex Corporation, Waterbury, Conn.

[21] Appl. No.: 434,020

[22] Filed: Oct. 12, 1982

[51] Int. Cl.[3] ..... G04B 29/00; G04C 17/00; H01H 3/12

[52] U.S. Cl. ..... 368/321; 368/319; 368/320; 200/159 R

[58] Field of Search ..... 368/69, 187, 190, 308, 368/319, 320, 321; 200/159 R, 159 A, 159 B

[56] References Cited

U.S. PATENT DOCUMENTS

| | | | |
|---|---|---|---|
| 3,884,033 | 5/1975 | Wood | 368/187 |
| 3,924,089 | 12/1925 | Abernethy | 200/159 R |
| 3,975,896 | 8/1976 | Kasama | 368/319 |
| 4,023,002 | 5/1977 | Wuthrich et al. | 200/159 R |
| 4,031,341 | 6/1977 | Wuthrich et al. | 200/159 R X |
| 4,031,348 | 6/1977 | Eberhardt | 200/159 R |
| 4,034,177 | 7/1977 | Sims, Jr. | 200/159 R |
| 4,043,115 | 8/1977 | Bryce land | 368/319 X |
| 4,057,698 | 11/1977 | Nakagawa et al. | 368/190 X |
| 4,135,359 | 1/1979 | Yajima | 368/190 |
| 4,344,161 | 8/1982 | Wakai | 368/69 |
| 4,346,464 | 8/1982 | Wenger | 368/319 X |
| 4,358,837 | 11/1982 | Yamazaki et al. | 368/69 |
| 4,364,674 | 12/1982 | Tesch | 368/319 |

FOREIGN PATENT DOCUMENTS 2086097 5/1982 United Kingdom .

*Primary Examiner*—B. Dobeck
*Assistant Examiner*—Terry L. Flower
*Attorney, Agent, or Firm*—William C. Crutcher

[57] ABSTRACT

A recessed push button in the back of an electronic watch is sealed and returned to its normal position by a resilient O-ring gasket, and retained in a recessed opening in the watch case by a spring retaining clip. The clip has a keyhole slot transversely slidable around a groove in the push button stem, with a retaining tab locking the clip in position. A first conductive member maintains contact with the clip, holding it in position, and a second conductive member is spaced from and contacted by the clip when the push button is depressed.

7 Claims, 7 Drawing Figures

PUSH BUTTON ASSEMBLY FOR A WATCH

BACKGROUND OF THE INVENTION

The present invention relates to a push button construction useful for an electronic watch. In electronic watches, whether of the digital type or the analog type with hands driven by a stepping motor, it is necessary to have switches which enable the user of the watch to advance the hands for setting or to select the functions performed by the internal integrated circuit. In the past, such push buttons usually have a seal or gasket to minimize or prevent moisture or other contaminants from entering the watch where electronic components might be adversely affected.

Push buttons are well known in the art of electronic watches, of the type where a push button is held in place by a spring retaining member holding the push button in position by means of spring fingers around a groove in the stem, the button being sealed by an O-ring resilient gasket sliding within a tube in the watch case. Such constructions are shown in U.S. Pat. Nos. 4,031,341 issued June 21, 1977 and 4,023,002 issued May 10, 1977, both in the names of Paul Wuthrich and Frank Mascia and assigned to the assignee of the present application. It is also known to use the resilient gasket to perform a spring return function as well as sealing, as shown in U.S. Pat. No. 4,031,348 issued June 21, 1977 to Noel Eberhardt.

Constructions have also been shown for incorporating a recessed push button in the underside of the watch, rather than on the edge, when the button is used infrequently for setting the watch. Such a push button is shown in U.K. patent application No. GB 2086097A assigned to ETA S.A. Fabriques D'Ebauches. In this application, elaborate means are employed to retain the button, maintain electrical contact, and to keep the assembly as thin as possible, so as not to increase the thickness of the watch.

Simplicity of manufacture and a minimum number of parts are desirable in a push button assembly for a watch. It would be very desirable to provide an improved retention means for a sealed push button assembly, particularly useful in the back of a thin watch.

Accordingly, one object of the present invention is to provide an improved sealed push button assembly for an electronic watch.

Another object of the invention is to provide an improved push button assembly utilizing a minimum number of parts and providing ease of assembly.

Another object of the invention is to provide an improved push button retaining means for a recessed button in the back of a very thin electronic watch.

DRAWING

The invention, both as to organization and method of practice, together with further objects and advantages thereof, will best be understood by reference to the following description, taken in connection with the accompanying drawings, in which:

FIG. 1 is an elevation drawing, partly in section, of a portion of the back of the watch case, FIGS. 1*a* and 1*b* are plan and elevation views respectively, partly in section, of the special spring retaining clip used in the assembly of FIG. 1, FIG. 1*c* is an elevation drawing of a portion of FIG. 1 showing the pushbutton in a depressed position, FIG. 2 is a plan view of a portion of the watch showing the push button assembly looking from the inside of the watch toward the back of the case, FIG. 3 is an elevation drawing, partly in section, of a modified form of the invention, and FIG. 4 is a fragmentary plan view of the modification shown in FIG. 3.

SUMMARY OF THE INVENTION

Briefly stated, the invention is practiced by providing the improvement in a watch having a case member, a recessed push button with a flange on one end and a stem extending through an opening in the watch case, and a resilient gasket between the flange and the case, the improvement comprising a spring retaining clip with an extending switch blade and a keyhole opening which is transversely slideable into a groove in the stem of the push button to hold it in place. The clip includes tab means to hold it in the push button locking position. A first electrically conductive member makes contact with the clip near the tab to hold it in place and a second electrically conductive member is disposed to be contacted by the extending switch blade when the push button is depressed, thereby completing contact between the first and second electrically conductive members. The pushbutton flange is joined to the stem by a pair of conical surfaces intersecting along an edge which guides the deformation of the gasket as it is compressed.

DESCRIPTION OF THE PREFERRED EMBODIMENT

Figure 1:
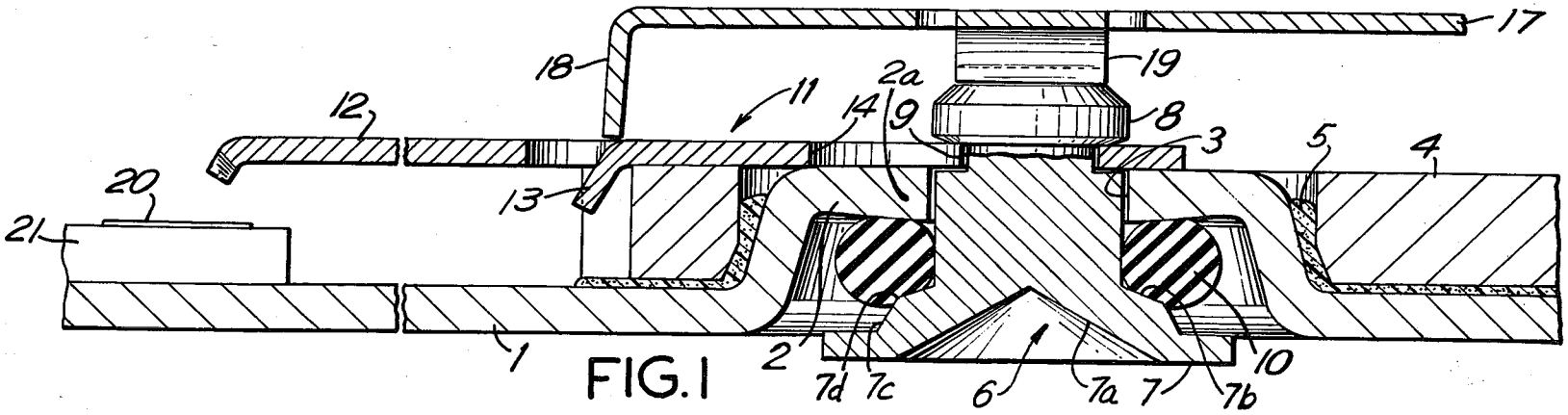

Referring now to FIG. 1 of the drawing, a portion is seen of the sheet metal caseback 1 of a watch, with a recess 2 formed therein and a hole 3. The recess 2 is shaped to slope away from the hole by means of a thickened wall section 2*a* near the hole 3. The case construction of the watch is made by laminating a brass frame member 4 to the thin stainless steel back 1 by means of epoxy or other sealant material shown at 5, the laminated case construction being referred to hereinafter as a "case member".

Extending through the hole 3 is a push button shown generally at 6 having a flange 7 on the outside of the watch, a stem 8 extending through the hole 3, and a groove 9 in the stem. The face of flange 7 is provided with an indentation 7*a* so that the push button can be operated with a ball point pen or the like. Disposed between the flange 7 and the wall of the case member is a resilient O-ring gasket 10 which provides both a sealing function between the push button and the case, as well as a spring return action to return the push button after it has been depressed. The flange 7 is joined to stem 8 by a pair of conical surfaces 7*b*, 7*c* intersecting along a circumferential edge 7*d* in contact with gasket 10. The edge 7*d* deforms the gasket 10 to expand it circumferentially into recess 2 of the caseback as the gasket is compressed when the push button 6 is depressed.

In accordance with the present invention, the improvement of means to hold the pushbutton and make electrical contact comprise an electrically conductive spring retaining clip 11, having an extending switch blade member 12, and a retaining tab 13 struck from the clip. A keyhole slot 14 in the clip provides means to hold the push button in place.

Figure 1A:
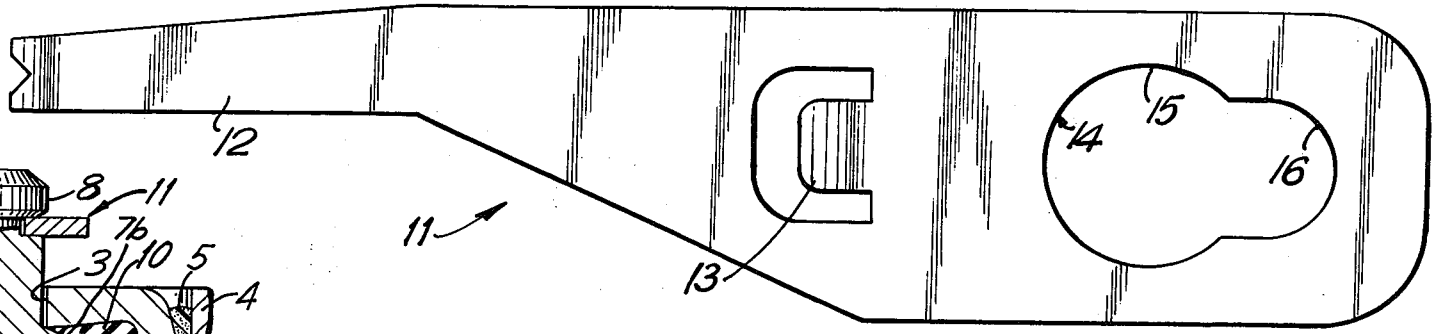
Figure 1B:
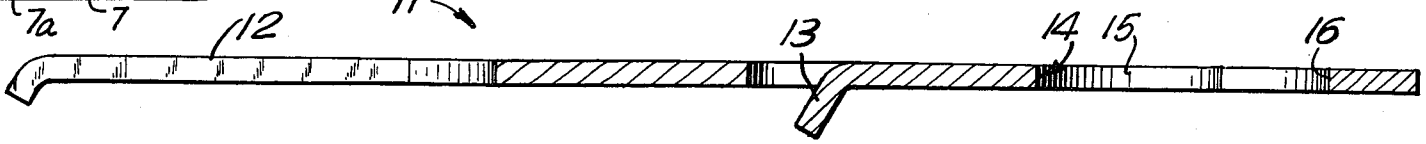
Figure 1C:
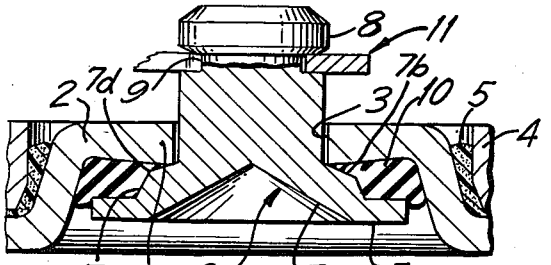

References to FIGS. 1*a* and 1*b* illustrate the parts of the spring retaining clip 11. The keyhole slot 14 includes a large diameter hole 15 which is large enough to slip over the end of the push button stem 8 and a connecting smaller diameter hole 16 which fits in the groove 9 of the stem when the spring retaining clip is slid transversely to the left.

A first conductive member 17, which is a sheet metal part with various tabs and fingers to perform several other function in the watch not material to the present invention, includes a downwardly extending ledge 18 making electrical contact across the spring clip in the vicinity of the retaining tab 13 and also preventing the tab from becoming disengaged. The conductive member 17 also has a spring tab 19 (See FIG. 2) which presses down on the stem of the pushbutton and thereby assists resilient gasket 10 in returning the push button to its normal position.

Lastly, a second electrically conductive member 20 is located spaced from and disposed to be contacted by the extending switch blade 12 when the blade is moved. In this case, conductive member 20 is a contact terminal on the substrate 21 of an integrated circuit.

Figure 2:
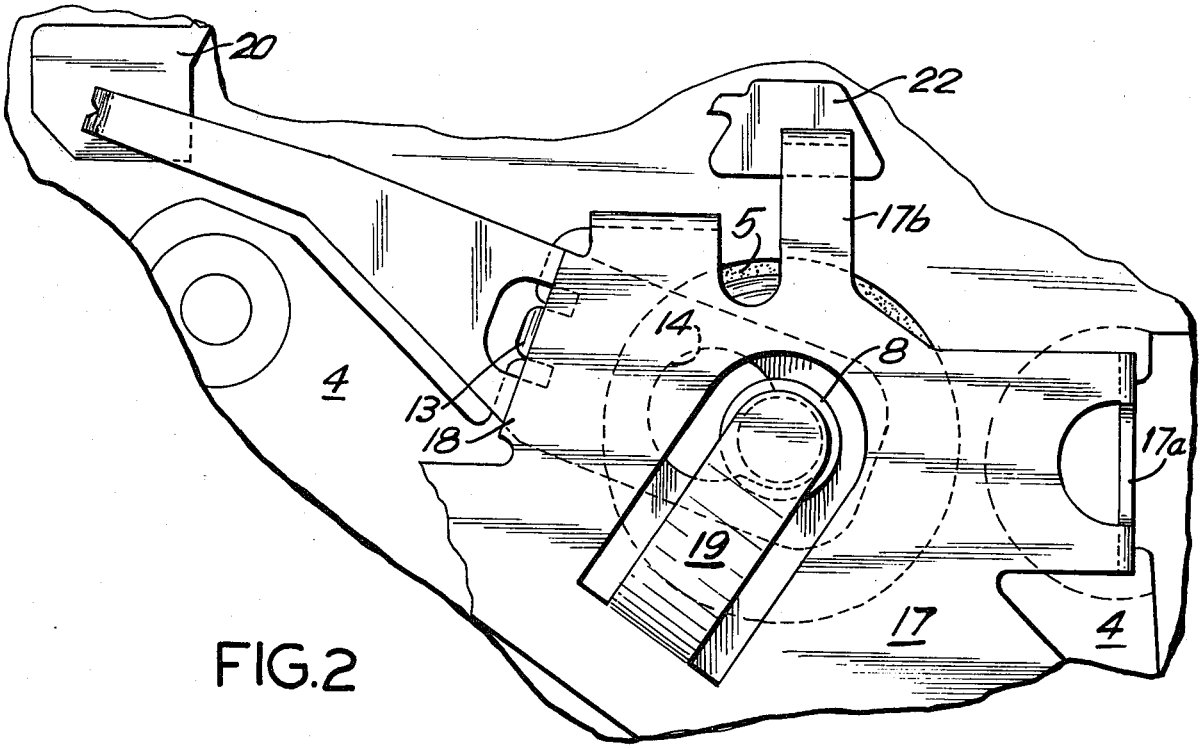

Reference to the plan view of FIG. 2 illustrates the relationship of the various parts in a watch more clearly. The first electrically conductive member 17 is partially held in place by means of a folded tab 17*a* which snaps into a recess formed in the brass frame member 4. Member 17 also includes an extending contact member 17*b* which makes electrical contact with a terminal pad 22 (similar to pad 20) on the integrated circuit substrate. The spring tab 19 is formed by a tongue cut from member 17 and bent down when the other tabs such as 17*a* are formed.

OPERATION OF THE PREFERRED EMBODIMENT

In order to assemble the push button assembly, the push button, with gasket around the stem is inserted from the back of the case. The spring retaining clip 12 is positioned with the larger diameter hole 15 over the stem and slid to the left. The smaller diameter portion 16 encircles groove 9 and the retaining tab 13 snaps over the end of the brass frame member 4. The resilient gasket 10 is compressed by edge 7*d* on the pushbutton 6 during this action so as to provide a seal and hold the push button in place. Subsequently, the first conductive member 17 may be assembled, so that the ledge 18 holds the spring clip down in the vicinity of the tab 13 and spring tab 19 provides additional spring return action for the push button. When the push button is depressed against the resilient gasket 10 and the spring tab 19, it raises the spring clip and tips the switch blade extension 12 down to make a contact point with the second electrical conductive member 20, completing contact between members 17 and 20. The frame 4 in the vicinity of the retaining tab 13 acts as the fulcrum, with push button on one side and the contact point between the switch blade extension and conductive member 20 on the other side of the fulcrum. In this case, the switch blade and the push button move in opposite directions.

Depressing the pushbutton causes the gasket 10 to expand circumferentially to cause the gasket to conform to the shape of the recess 2. This expansion is aided by the sloping wall of the recess and causes the gasket to retain sufficient volume beneath the flange 7 of the pushbutton. This, in turn, generates a more equalized reacting force over the whole stroke of the pushbutton, improves the sealing, and prevents losing the gasket. At the bottom of the pushbutton stroke, the conical surface 7*b* acts as a stop.

MODIFICATION OF THE INVENTION

Figure 3:
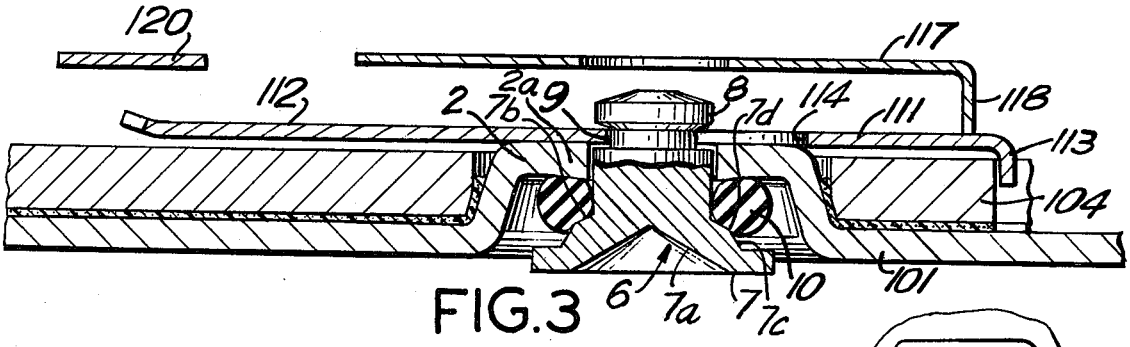
Figure 4:
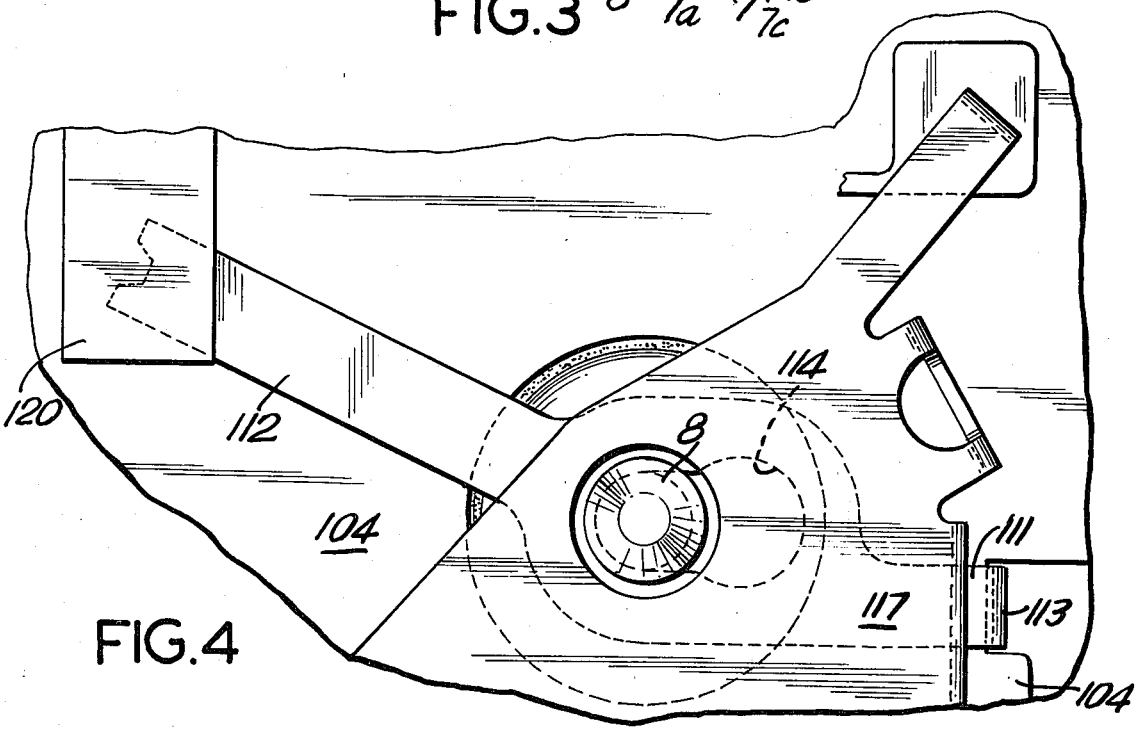

FIGS. 3 and 4 illustrate a modified form of the invention, having analogous members to the preferred embodiment, except that the push button is located between the fulcrum and the contact point of the switch blade extension. A stainless steel caseback 101 and a brass frame member 104 are laminated together as before. The push button 6 and resilient gasket 10 may be as previously described. A spring retaining clip 111 includes a retaining tab 113 on one end and an extending switch blade 112 on the other end. A keyhole shaped cutout 114 is arranged to lock the retaining clip over the push button when it is transversely slid to the right, so that the retaining tab 113 snaps over the cutout in the edge of brass frame member 104 (See FIG. 4). A first electrically conductive member 117 includes a ledge 118 holding the clip down in the vicinity of the retaining tab 113. A second electrically conductive member 120 is connected to a contact pad on the substrate of the integrated circuit, spaced from and disposed to be contacted by the switch blade 112 when it is moved.

In operation, the spring retaining clip is attached as previously described. When the push button 6 is depressed, the frame beneath the right end acts as the fulcrum and switch blade extension 112 is raised to contact the second conductive member 120, thereby completing contact between it and the first conductive member 117. In this case, the switch blade moves in the same direction as the push button. The action of the conical shapes on the pushbutton against the gasket is the same as previously described.

The foregoing described invention provides an extremely simple construction for a push button assembly suitable for an electronic watch, particularly suitable for a recessed button disposed in the back of a thin watch.

While there has been disclosed what is considered to be the preferred embodiment of the invention and one modification thereof, other modifications will occur to those skilled in the art, and it is desired to include in the appended claims all such modifications as fall within the true spirit and scope of the invention.

I claim:

1. An improved push button assembly for a watch of the type having a case member defining a recessed hole, a push button having a stem extending through said hole and a circumferential flange, the stem portion extending beyond the hole and having a circumferential groove therein, and a resilient gasket disposed between the flange and the case member, the improvement comprising:

a spring retaining clip having an extending switch blade said clip defining a keyhole opening therein with a larger diameter portion disposed to fit over the end of the push button stem and a connected smaller diameter portion adapted to fit in the groove of the stem when the spring retaining clip is slid transversely, said clip having tab retaining means adapted to snap over a portion of the case member when the clip is slid transversely, a first electrically conductive member having a portion adapted to hold and make electrical contact with said clip in the vicinity of said retaining tab, and a second electrically conductive member spaced from and disposed be contacted by the extending switch blade of the clip when said push button is depressed against the case member.

2. The improvement according to claim 1, wherein said keyhole slot is disposed between said retaining tab and said switch blade, whereby switch blade moves in the same direction as the push button.

3. The improvement according to claim 1, wherein said retaining tab is disposed between the keyhole slot and the switch blade, whereby the push button and the switch blade move in opoosite directions.

4. The improvement according to claim 1, wherein said first conductive member includes a tongue providing a spring tab contacting the end of the push button stem, thereby assisting in the spring return action along with that of the resilient gasket.

5. The improvement according to claim 1, wherein said first conductive member includes a depending ledge contacting the retaining clip in the vicinity of said retaining tab, to make electrical contact and to prevent the retaining tab from becoming disengaged.

6. The improvement according to claim 1, wherein said stem and said circumferential flange are connected by a pair of conical surfaces intersecting along a circumferential edge contacting said gasket, and adapted to expand the gasket circumferentially as the pushbutton is depressed.

7. The improvement according to claim 1, wherein said case member slopes away from said recessed hole in the case member, and is adapted to guide the resilient gasket circumferentially outward as the pushbutton is depressed.

* * * * *